US005566870A

United States Patent [19]

Mejeur

[11] Patent Number: 5,566,870

[45] Date of Patent: Oct. 22, 1996

[54] AUXILIARY CARRYING HANDLE FOR GOLF BAGS

[76] Inventor: Roger Mejeur, 526 Campbell St., Kalamazoo, Mich. 49006

[21] Appl. No.: 238,489

[22] Filed: May 5, 1994

[51] Int. Cl.[6] ..... A63B 55/00

[52] U.S. Cl. ..... 224/218; 224/264; 206/315.3; 294/150

[58] Field of Search ..... 224/218, 264, 224/267, 917; 206/315.3; 294/150, 165

[56] References Cited

U.S. PATENT DOCUMENTS

| | | | |
|---|---|---|---|
| 946,850 | 1/1910 | Tabler | 294/150 x |
| 4,958,758 | 9/1990 | Tipple et al. | 224/267 |
| 5,042,654 | 8/1991 | Jones | 206/315.3 |
| 5,255,947 | 10/1993 | Schwartz | 294/150 X |
| 5,307,966 | 5/1994 | Inaba et al. | 224/218 X |

*Primary Examiner*—Renee S. Luebke

[57] ABSTRACT

A new auxiliary handle for golf bags facilitates carrying a conventional golf bag having a single shoulder strap attached to the upper portion thereof with a new supplemental gripping handle connectable to the base of the golf bag. The weight of the golf bag is partially redistributed from a user's strap-bearing shoulder to the user's hand when grasping the auxiliary handle and elevating the golf bag so that the bag is held generally horizontally. The apparatus includes a flexible belt having dimensions for encircling the golf bag proximal the base end thereof. A hand grip is included on the belt whereby the user may comfortably support the base of the golf bag in an elevated position. The hand grip is a resilient elongated cushion having a longitudinal hole therethrough. A flexible attachment strap extends through the longitudinal hole in the cushion. The strap is fixedly connected at both ends to the belt whereby a user may grip the cushion without touching the belt and golf bag to prevent chafing the user's hand.

5 Claims, 3 Drawing Sheets

FIG. 1
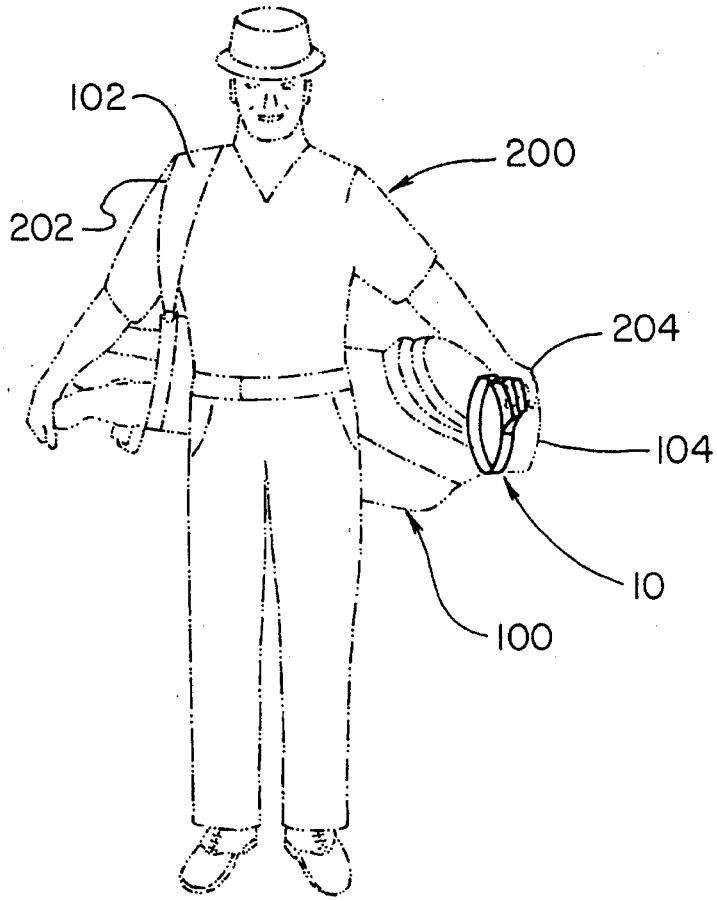
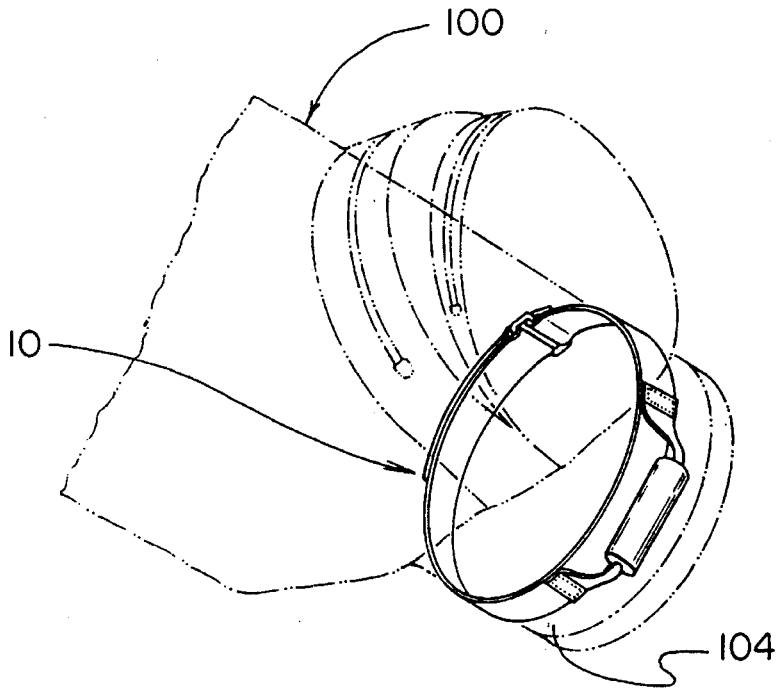
FIG. 2

AUXILIARY CARRYING HANDLE FOR GOLF BAGS

BACKGROUND OF THE INVENTION

1. Field of the Invention

The present invention relates to golf bag carrying devices and more particularly pertains to an auxiliary carrying handle for golf bags which may be adapted for facilitating carrying of a conventional golf bag having a single shoulder strap attached to the upper portion thereof.

2. Description of the Prior Art

The use of golf bag carrying devices is known in the prior art. More specifically, golf bag carrying devices heretofore devised and utilized for the purpose of supporting a golf bag on a user's body above the ground while being transported by a walking user are known to consist basically of familiar, expected and obvious structural configurations, notwithstanding the myriad of designs encompassed by the crowded prior art which have been developed for the fulfillment of countless objectives and requirements.

The present invention is directed to improving devices for carrying golf bags in a manner which is safe, secure, economical and aesthetically pleasing.

For example, U.S. Pat. No. 4,487,347 to Zegar discloses a golf bag and carrying device that includes an elongated rigid bar which is attachable to a conventional single strap golf bag. The bar includes perforations and two shoulder straps are attachable thereto at the perforations. U.S. Pat. No. 5,042,703 to Izzo describes a dual strap carrying system for golf bags having first and second strap members connected in end-to-end relation to one another along one side of the golf bag, a handle grip interconnecting adjoining ends of the strap members, and circumferential loops serve to connect opposite extreme ends of the first and second strap members to the golf bag in such a way as to maintain the bag in centered relation against the back of the carrier when the straps are passed over the shoulders. While both of the inventions described above serve the purpose of centering the golf bag on the user's back, neither of these devices comprise a handle attachable to the base of the golf bag. Furthermore, both of the devices described replace rather than augment an existing golf bag carrying strap.

The prior art also discloses a golf bag carrying strap as shown in U.S. Pat. No. D. 337,197 to Krutsch et al., a golf bag carrier of U.S. Pat. No. 4,387,836 to Laesch, and a carrying handle for golf bag shown in U.S. Pat. No. 3,548,905 to Renshaw. While these devices fulfill their respective, particular objectives and requirements, the aforementioned patents do not disclose an auxiliary carrying handle for golf bags for facilitating carrying of a conventional golf bag having a single shoulder strap attached to the upper portion thereof with a new supplemental gripping handle connectable to the base of the golf bag whereby the weight of the golf bag is redistributed from a user's strap-bearing shoulder to a point central the user's shoulders when the auxiliary handle is gripped in the user's hand to elevate the base of the golf bag so the bag is held generally horizontally.

In this respect, the auxiliary carrying handle for golf bags according to the present invention substantially departs from the conventional concepts and designs of the prior art, and in so doing provides an apparatus primarily developed for the purpose of facilitating carrying of a conventional golf bag having a single shoulder strap attached to the upper portion thereof with a new supplemental gripping handle connectable to the base of the golf bag whereby the weight of the golf bag is redistributed from a user's strap-bearing shoulder to a point central the user's shoulders when the auxiliary handle is gripped in the user's hand to elevate the base of the golf bag so the bag is held generally horizontally.

Therefore, it can be appreciated that there exists a continuing need for new auxiliary carrying handles for golf bags which can be used for facilitating carrying of a conventional golf bag having a single shoulder strap attached to the upper portion thereof with a new supplemental gripping handle connectable to the base of the golf bag whereby the weight of the golf bag is redistributed from a user's strap-bearing shoulder to a point central the user's shoulders when the auxiliary handle is gripped in the user's hand to elevate the base of the golf bag so the bag is held generally horizontally. In this regard, the present invention substantially fulfills this need.

As illustrated by the background art, efforts are continuously being made in an attempt to develop devices for supporting a golf bag on a user's body above the ground while being transported by a walking user. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of golf bag carrying devices now present in the prior art, the present invention provides a new golf bag carrying devices construction wherein the same can be utilized for facilitating carrying of a conventional golf bag having a single shoulder strap attached to the upper portion thereof with a new supplemental gripping handle connectable to the base of the golf bag whereby the weight of the golf bag is redistributed from a user's strap-bearing shoulder to a point central the user's shoulders when the auxiliary handle is gripped in the user's hand to elevate the base of the golf bag so the bag is held generally horizontally. As such, the general purpose of the present invention, which will be described subsequently in greater detail, is to provide a new auxiliary carrying handle for golf bags apparatus and method which has all the advantages of the prior art golf bag carrying devices and none of the disadvantages.

The invention is defined by the appended claims with the specific embodiment shown in the attached drawings. For the purpose of summarizing the invention, the invention may be incorporated into a new auxiliary carrying handle for golf bags that facilitates carrying a conventional golf bag having a single shoulder strap attached to the upper portion thereof with a new supplemental gripping handle connectable to the base of the golf bag. The weight of the golf bag is partially redistributed from a user's strap-bearing shoulder to the user's hand when grasping the auxiliary handle and elevating the golf bag so that the bag is held generally horizontally. The auxiliary carrying handle for golf bags comprises a flexible belt, constructed of nylon webbing or the like, having dimensions for encircling the golf bag proximal the base end thereof. The belt has securement means whereby the ends of the belt may be adjustably removedly secured together for retaining the belt around different golf bags having various circumferential dimensions. The securement means comprises a first belt end having a rigid plastic ring fixedly connected thereto such that the ring extends coplanarly from the end of the belt. The first belt end extends through the ring and is folded back on itself being fixedly secured by a plurality of threads or stitches. A second belt end has a strip of loop tape material disposed along the outside surface proximal the end thereof and a cooperable strip of hook tape material also disposed along the outside surface of the belt. The strip of hook tape material is spaced longitudinally slightly apart from the loop material intermediate the loop material and the first end of the belt. In the securement mode the second belt end extends through the ring of the first end such that the second end overlaps itself to bring the loop material into operable engagement with the hook material. The hook and loop material strips each have sufficient length to allow circumferential adjustment of the belt, by varying the amount the second belt end extends through the ring, to accommodate a specific range of golf bag diameters. A hand grip whereby the user may comfortably support the base of the golf bag in an elevated position is included. The hand grip comprises a resilient elongated cushion, formed of foal rubber or the like, having a longitudinal hole therethrough. A flexible attachment strap, constructed of nylon webbing or the like, extends through the longitudinal hole in the cushion, the strap being fixedly connected at both ends to the belt by a plurality of threads or stitches. The ends of the strap are spaced apart so the strap lies parallel to and slightly away from the belt, intermediate the ends of the belt, whereby a user may grip the cushion without touching the belt and golf bag to prevent chafing the user's hand.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art ,can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an auxiliary carrying handle for golf bags for facilitating carrying of a conventional golf bag having a single shoulder strap attached to the upper portion thereof with a new supplemental gripping handle connectable to the base of the golf bag whereby the weight of the golf bag is redistributed from a user's strap-bearing shoulder to a point central the user's shoulders when the auxiliary handle is gripped in the user's hand to elevate the base of the golf bag so the bag is held generally horizontally.

It is another object of the present invention to provide a new auxiliary carrying handle for golf bags which may be easily and efficiently manufactured and marketed.

It is a further object of the present invention to provide a new auxiliary carrying handle for golf bags which is of a durable and reliable construction.

An even further object of the present invention is to provide a new auxiliary carrying handle for golf bags which is susceptible of a low cost of manufacture with regard to both materials and labor, and which accordingly is then susceptible of low prices of sale to the consuming public, thereby making such auxiliary carrying handles for golf bags economically available to the buying public.

Still yet another object of the present invention is to provide a new auxiliary carrying handle for golf bags which provides in the apparatuses and methods of the prior art some of the advantages thereof, while simultaneously overcoming some of the disadvantages normally associated therewith.

Still yet another object of the present invention is to provide a new auxiliary carrying handle for golf bags that is lightweight so not to increase the golfer's weight load.

Yet another object of the present invention is to provide a new auxiliary carrying handle for golf bags that is essentially universal in design to fit all conventional golf bags without modification.

Even still another object of the present invention is to provide a new auxiliary carrying handle for golf bags that does not interfere with normal use of the golf bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the new auxiliary carrying handle for golf bags showing its manner of use.

FIG. 2 is an enlarged perspective view of the invention of FIG. 1 showing its manner of attachment to a golf bag.

DESCRIPTION OF THE PREFERRED EMBODIMENT

Figure 3:
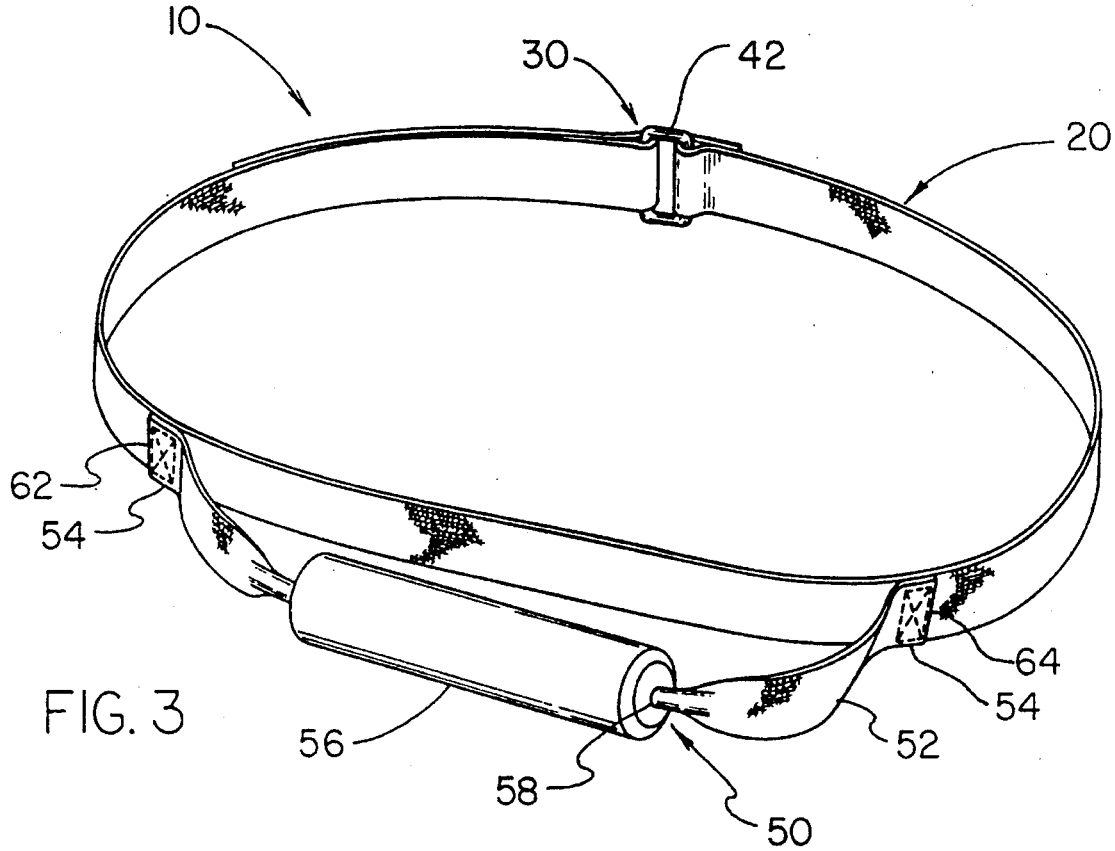
FIG. 3 is a perspective view of the present invention.
Figure 4:
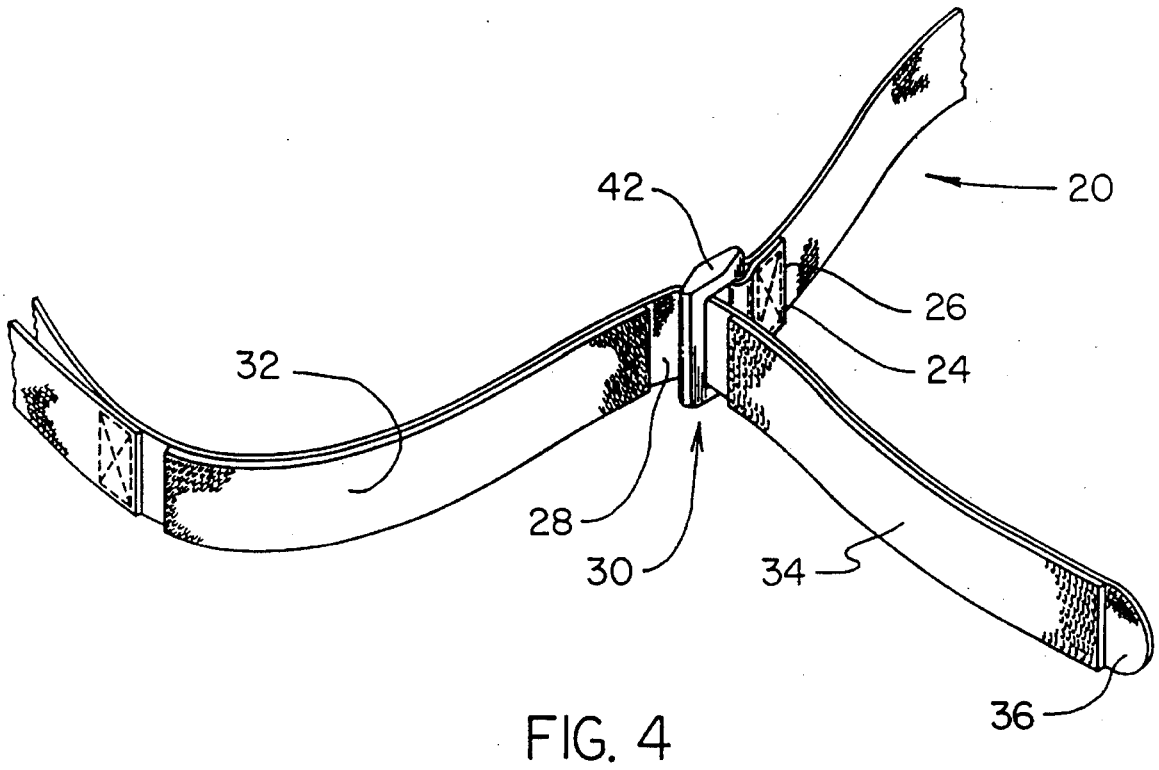
FIG. 4 is a perspective detail view of the invention of FIG. 3 illustrating the manner of construction of the belt securement means.
Figure 5:
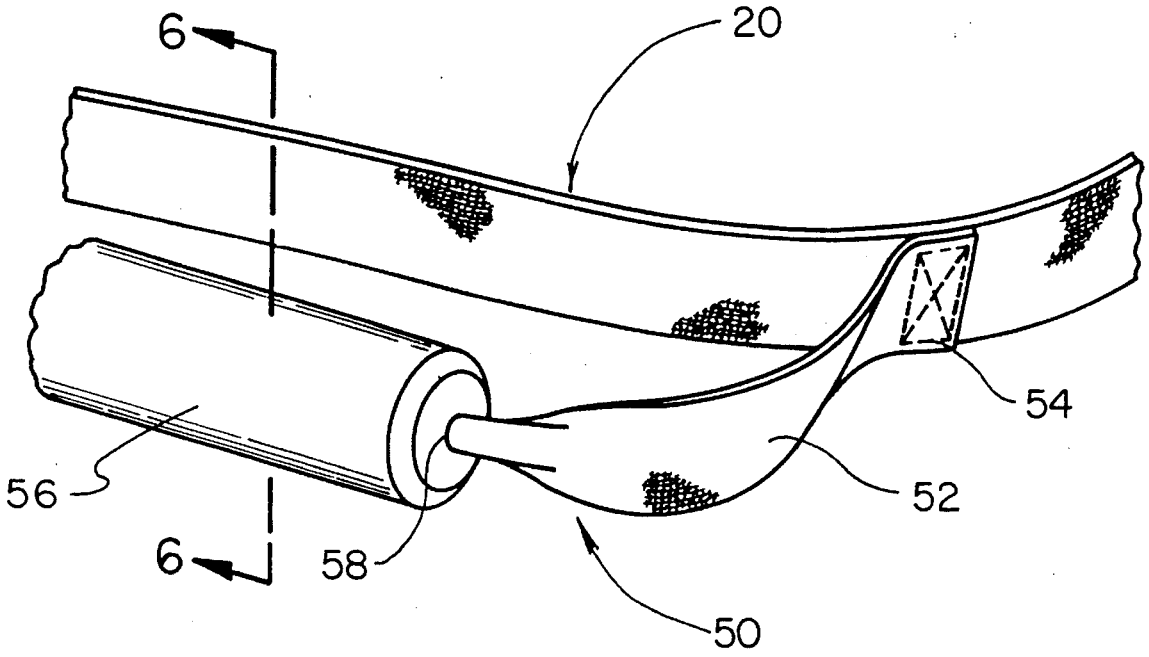
FIG. 5 is a perspective detail view of the invention of FIG. 3 showing the manner of construction of the hand grip.
Figure 6:
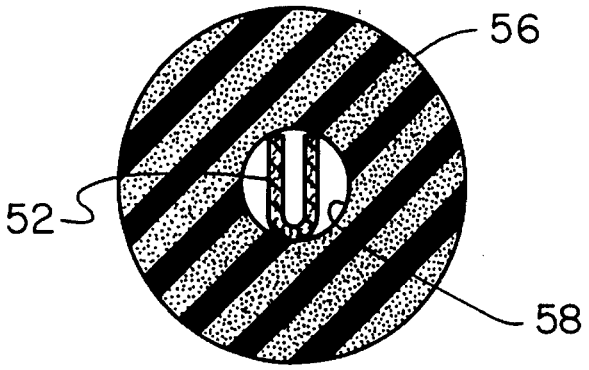
FIG. 6 is a sectional view of the invention of FIG. 5 taken along the line 6—6.

With reference now to the drawings, and in particular to FIG. 3 thereof, a new auxiliary carrying handle for golf bags embodying the principles and concepts of the present invention and generally designated by the reference numeral 10 will be described.

From an overview standpoint, the auxiliary carrying handle for golf bags is adapted for use for facilitating carrying of a conventional golf bag having a single shoulder strap 102 attached to the upper portion thereof with a new supplemental gripping handle connectable to the base of the golf bag whereby the weight of the golf bag is partially redistributed from a user's strap-bearing shoulder 202 to the user's hand when grasping the auxiliary handle and elevating the golf bag so that the bag is held generally horizontally. See FIG. 1.

With reference now to FIGS. 1–6 and more specifically, it will be noted that a new auxiliary carrying handle for golf bags 10 is shown. The auxiliary carrying handle for golf bags 10 comprises a flexible belt 20, constructed of nylon webbing or the like, having dimensions for encircling the golf bag proximal the base end 104 thereof. The belt 20 has securement means 30 whereby the ends 24 and 36 of the belt may be adjustably removedly secured together for retaining the belt 20 around different golf bags having various circumferential dimensions. The securement means 30 comprises a first belt end 24 having a rigid plastic ring 42 fixedly connected thereto such that the ring 42 extends coplanarly from the end 24 of the belt 20. The first belt end 24 extends through the ring 42 and is folded back on itself being fixedly secured by a plurality of threads or stitches 26.

A second belt end 36 has a strip of loop tape material 34 disposed along the outside surface proximal the end 36 thereof and a cooperable strip of hook tape material 32 also disposed along the outside surface of the belt 20. The strip of hook tape material 32 is spaced longitudinally slightly apart from the loop material 34 intermediate the loop material 34 and the first end 24 of the belt 20. In the securement mode the second belt end 36 extends through the ring 42 of the first end such that the second end 36 overlaps itself to bring the loop material 34 into operable engagement with the hook material 32. The hook and loop material strips 32 and 34 each have sufficient length to allow circumferential adjustment of the belt 20, by varying the amount the second belt end 36 extends through the ring 42, to accommodate a specific range of golf bag diameters.

A portion of the second end 36 is clear of the loop tape material 34 to provide a gripping tab for easy disengagement of the securement means 30. A hand grip 50 whereby the user may comfortably support the base 104 of the golf bag 100 in an elevated position is included. The hand grip 50 comprises a resilient elongated cushion 56, formed of foam rubber or the like, having a longitudinal hole 58 therethrough. A flexible attachment strap 52, constructed of nylon webbing or the like, extends through the longitudinal hole 58 in the cushion, the strap 52 being fixedly connected at both ends 62 and 64 to the belt 20 by a plurality of threads or stitches 54. The ends 62 and 64 of the strap 52 are spaced apart so the strap 52 lies parallel to and slightly away from the belt 20, intermediate the ends 24 and 36 of the belt 20, whereby a user 200 may grip the cushion 56 without touching the belt 20 and golf bag 100 to prevent chafing the user's hand 204.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new auxiliary carrying handle for golf bags for facilitating carrying of a conventional golf bag having a single shoulder strap attached to the upper portion thereof with a new supplemental gripping handle connectable to the base of the golf bag whereby the weight of the golf bag is partially redistributed from a user's strap-bearing shoulder to the user's hand when grasping the auxiliary handle and elevating the golf bag so that the bag is held generally horizontally, the weight upon the user's shoulder being somewhat lessened by the weight carried by the user's hand, the auxiliary carrying handle for golf bags comprising:

a flexible belt having dimensions for encircling the golf bag proximal the base end thereof, the belt having securement means whereby the ends of the belt may be adjustably removedly secured together for retaining the belt around different golf bags having various circumferential dimensions; and a hand grip whereby the user may comfortably support the base of the golf bag in an elevated position, the hand grip comprising a resilient elongated cushion having a longitudinal hole therethrough and a flexible attachment strap extending through the longitudinal hole in the cushion, the strap being fixedly connected at both ends to the belt, the ends of the strap being spaced apart so the strap lies parallel to and slightly away from the belt intermediate the ends of the belt whereby a user may grip the cushion without touching the belt and golf bag to prevent chafing the user's hand.

2. The auxiliary carrying handle for golf bags of claim 1 wherein the belt is constructed of nylon webbing.

3. The auxiliary carrying handle for golf bags of claim 2 wherein the attachment strap is constructed of nylon webbing.

4. The auxiliary carrying handle for golf bags of claim 3 wherein the grip cushion is formed of foam rubber.

5. The auxiliary carrying handle for golf bags of claim 4 wherein the belt securement means comprises: a first belt end having a rigid plastic ring fixedly connected thereto, the ring extending coplanarly from the end of the belt; a second belt end having a strip of loop tape material disposed along the outside surface proximal the end thereof and a cooperable strip of hook tape material also disposed along the outside surface of the belt spaced longitudinally slightly apart from the loop material intermediate the loop material and the first end, the second belt end extending through the ring of the first end in the securement mode so the second end overlaps itself to bring the loop material into operable engagement with the hook material, the hook and loop material strips each having sufficient length to allow circumferential adjustment of the belt to accommodate a specific range of golf bag diameters.

* * * * *